US009737823B2

(12) United States Patent
Norton

(10) Patent No.: US 9,737,823 B2
(45) Date of Patent: Aug. 22, 2017

(54) MECHANICAL SPINNING TOY

(71) Applicant: Rocky Lynn Norton, Watford City, ND (US)

(72) Inventor: Rocky Lynn Norton, Watford City, ND (US)

( * ) Notice: Subject to any disclaimer, the term of this patent is extended or adjusted under 35 U.S.C. 154(b) by 0 days.

(21) Appl. No.: 15/267,633

(22) Filed: Sep. 16, 2016

(65) Prior Publication Data

US 2017/0080351 A1 Mar. 23, 2017

Related U.S. Application Data

(60) Provisional application No. 62/219,691, filed on Sep. 17, 2015.

(51) Int. Cl.
*A63H 3/20* (2006.01)
*A63H 33/00* (2006.01)

(52) U.S. Cl.
CPC ..... *A63H 33/00* (2013.01)

(58) Field of Classification Search
CPC ... A63H 3/00; A63H 3/20; A63H 3/48; A63H 3/50; A63H 13/00; A63H 13/18; A63H 15/00; A63H 15/04
USPC ..... 446/236, 246, 266, 322, 323
See application file for complete search history.

(56) References Cited

U.S. PATENT DOCUMENTS 1,759,181 A * 5/1930 Andrew ..... A63H 7/00 446/322
3,610,620 A * 10/1971 Stein ..... A63F 9/14 446/236
4,419,841 A 12/1983 Huang
4,934,981 A 6/1990 Stulbach
5,360,366 A 11/1994 Lin
5,518,437 A 5/1996 Nonaka et al.
5,823,845 A 10/1998 O'Berrigan
6,364,734 B1 4/2002 Ng

* cited by examiner

*Primary Examiner* — Kien Nguyen
(74) *Attorney, Agent, or Firm* — Dale J. Ream

(57) ABSTRACT

A mechanical spinning toy provides a rectangular body, with a cylindrical handle protruding perpendicularly from the center of each long side. The handles provide an axis of rotation for a swing, with two arms extending down the long sides of the body and terminating in a plate with a narrow clearance from the end of the body. The swing rotates easily around the axis of the handles in a 360° arc. An aperture extends longitudinally through the centerline of the body, containing a cylindrical stopper head. A simple mechanism causes the stopper head to protrude a short distance from one end of the body or the other, and may be retracted with a quick twist of the user's wrists or a quick press of the user's thumb. This enables the swing to continue rotating around the body.

13 Claims, 2 Drawing Sheets

MECHANICAL SPINNING TOY

CROSS-REFERENCE TO RELATED APPLICATIONS

This Application claims the benefit of U.S. Provisional Application No. 62/219,691, filed Sep. 17, 2015, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to toys, games, and novelties, and in particular to a mechanical spinning toy. New toys in the 21st Century usually involve a microprocessor, a bundle of batteries, and a substantial price tag. They are vulnerable to a few drops of water or one fall from the edge of a table. If they are lost or damaged, or if a child loses interest in them, they represent a significant lost investment. Unfortunately, millions of parents are trapped in a cycle of buying new, expensive electronic toys to replace those that are lost or damaged.

Adding a few sturdy, inexpensive mechanical toys to the mix would reduce these costs. A broad assortment of older toy designs are available, both new and used, but a new mechanical toy design without electronic components would be well received.

Alternatively swinging and twisting toy, U.S. Pat. No. 4,419,841 (filed Sep. 7, 1982), provides a motor operated toy, having a pair of moving cams which are synchronously driven to cause a swinging motion of the toy. The toy is further formed with a pair of spring loaded feet for augmenting the swinging motion of the toy as the toy moves across a supporting surface, which is also engaged by the moving cams. A pair of crank operated limbs are also disclosed.

Swinging toy, U.S. Pat. No. 4,934,981 (filed Jul. 27, 1989), provides a swinging toy which comprises a U-shaped frame having two spaced parallel support rods and a connecting fulcrum rod. A figure comprises a body member simulating a head and shoulders with two arm members rotationally connected to the body member at the simulated shoulders. An outer string line is connected between the parallel support rods near one end of the frame and passes through inner openings of the arm members. An inner string line is connected between the parallel support rods parallel to and adjacent the outer string line and passes through outer openings of the arm members. When the frame is placed in a vertical position with the figure at the top, gravity will cause the body member to move around the inner and outer string lines to take an upside-up position below the inner string line, which causes the inner and outer string lines to cross each other. When the ends of the parallel support rods at the bottom of the frame are moved toward each other, the parallel string lines are pulled back to a parallel position so that the body member counter rotates around the inner and outer string lines back to an upside-up position beneath the inner string line, which causes the inner and outer string lines to cross each other, but in an opposite direction. Repeated movement toward each other of the bottom ends of the parallel support rods causes the body member to repeatedly rotate and counter rotate around the inner and outer string lines. Also disclosed are an electrically-operated embodiment, a weighted free standing embodiment and a multi-jointed figure.

Wobbling toy, U.S. Pat. No. 5,360,366 (filed Dec. 22, 1993), provides a wobbling toy which includes a hollow platform, a first magnet unit a soft toy housing including a head and a body and a driving mechanism. The first magnet unit is disposed horizontally and mounted rotatably adjacent to the top surface of the platform. The driving mechanism is operable so as to drive rotatably the first magnet unit. The toy body unit rests on the top surface of the platform. The toy body unit further includes a pivot plate which has two distal ends connected pivotally to the wall of the toy body and a vertically extending swing rod which has an intermediate portion that extends through and that is connected to the pivot plate. The swing rod further has a lower end with a second magnet unit mounted thereon and disposed adjacent to the platform and an upper end disposed within the head of the soft toy housing. In operation, the first magnet unit is oscillated by the driving mechanism so as to alternately attract and repel the second magnet unit, to cause the swing rod within the toy body unit to swing. As a result, the toy body unit wobbles on the platform and the head of the toy housing wobbles relative to the body thereof.

Mobile, gyroscopically stabilized toy with controlled multi-action movements, U.S. Pat. No. 5,823,845 (filed Mar. 12, 1996), provides a toy having a body for housing and supporting its various constituent elements, the elements including: a gyroscopic mechanism, mounted therein so as to gyrostabilize the toy, which includes a rotor mounted on an axle and a mechanism for attaching the axle so that it is free to rotate about one or both of two axes which are perpendicular to each other and to the axis of spin; a selectively, intermittently operable drive mechanism for causing the axle and the rotor to spin with sufficient speed to gyrostabilize the toy; one or more appendages attached to and supported by the body portion of the toy, optionally operatively connected by a transmission to the selectively, intermittently operable drive mechanism, or to an independent drive mechanism, for moving the one or more appendages in a predetermined manner; and a mechanism for permitting independent directional movement of the toy, on which the body portion is supported and which resists the natural precessional forces of the gyroscopic means.

Toy top and drive unit for spinning the top, U.S. Pat. No. 5,518,437 (filed Oct. 12, 1993), provides a toy top which can also be used as a badge, and a drive unit which can mechanically spin the toy top with ease in a simple manner. The toy top has first engaging portions on the upper surface of the main body thereof, a first hook portion on the outer periphery thereof and a central spindle about which a knob is removably screw-fitted. The toy top comprises a main body having first engaging portions, a first hook portion and a central spindle screw-fitted with a knob while the drive unit comprises a rotatable member having second engaging portions to engage the first engaging portions of the toy top, a spring for rotating the rotatable member, a second hook portion to engage the second hook portion of the toy top and operating member for releasing the engagement of the second hook portion with the first hook portion of the toy top. Further, some modifications of the structures of the toy top and the drive unit are also disclosed. Where the toy top is used as a badge, the knob fitted on the central spindle of the main body of the toy top is first removed and after passing the spindle through the user's clothing, the knob is fitted again on the spindle.

Toy top structure and system, U.S. Pat. No. 6,364,734 (filed Apr. 14, 2000), provides a toy top system that uses uniquely configured tops. The system contains a plurality of toy tops that can be stacked on top of one another while spinning. Each of the tops has a value for rotational inertia associated with it. At least some of the tops are configured to have a value for rotational inertia that varies as a function of the rotational speed of the top. The tops with a variable rotational inertia are capable of storing and providing rotational energy while maintaining a near constant rate of rotation.

A spinning or revolving motion has proven to be an attractive feature for a toy, and there are several existing designs, but no new designs in this area have emerged for several years. A mechanical spinning toy, which provides sturdy construction and a fascinating spinning action, would help to resolve this problem.

SUMMARY OF THE INVENTION

Accordingly, the invention is directed to a mechanical spinning toy. The toy provides a rectangular body, with a cylindrical handle protruding perpendicularly from the center of each long side. The handles provide an axis of rotation for a swing, with two arms extending down the long sides of the body and terminating in a plate with a narrow clearance from the end of the body. The swing rotates easily around the axis of the handles in a 360° arc. An aperture extends longitudinally through the centerline of the body, containing a cylindrical stopper head. A simple mechanism causes the stopper head to protrude a short distance from one end of the body or the other, and may be retracted with a quick twist of the user's wrists or a quick press of the user's thumb. This enables the swing to continue rotating around the body.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
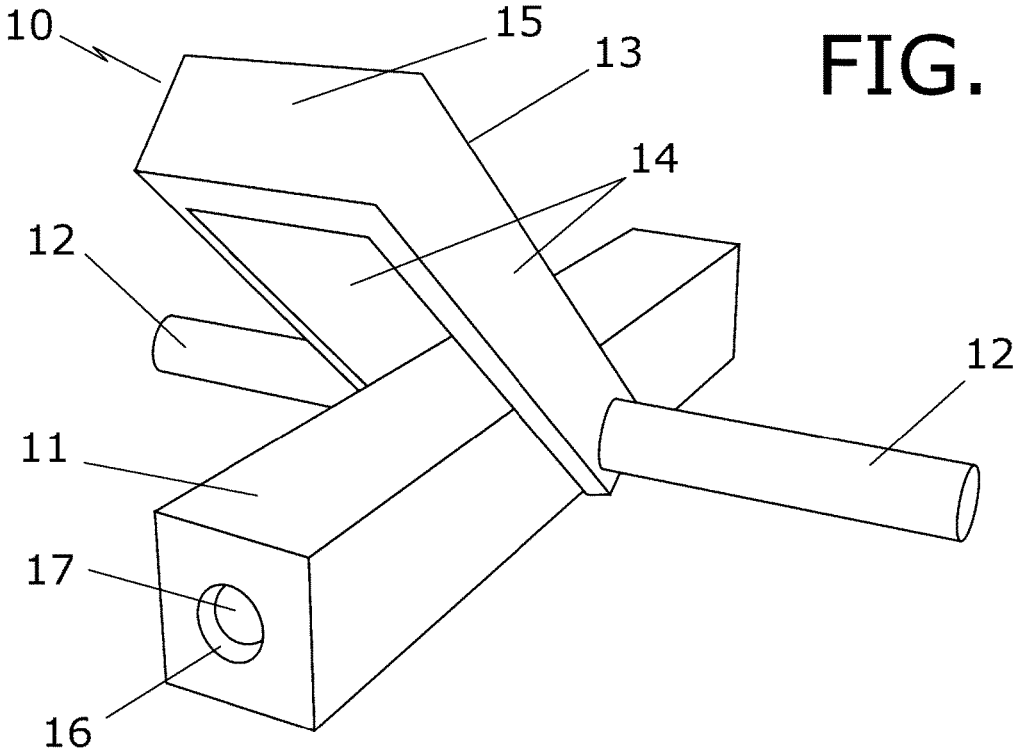
FIG. 1 is a front perspective view of the first exemplary embodiment with the stopper head retracted, displaying the toy 10, the body 11, the handles 12, the swing 13, the arms 14, the plate 15, the aperture 16, and the stopper head 17.
Figure 2:
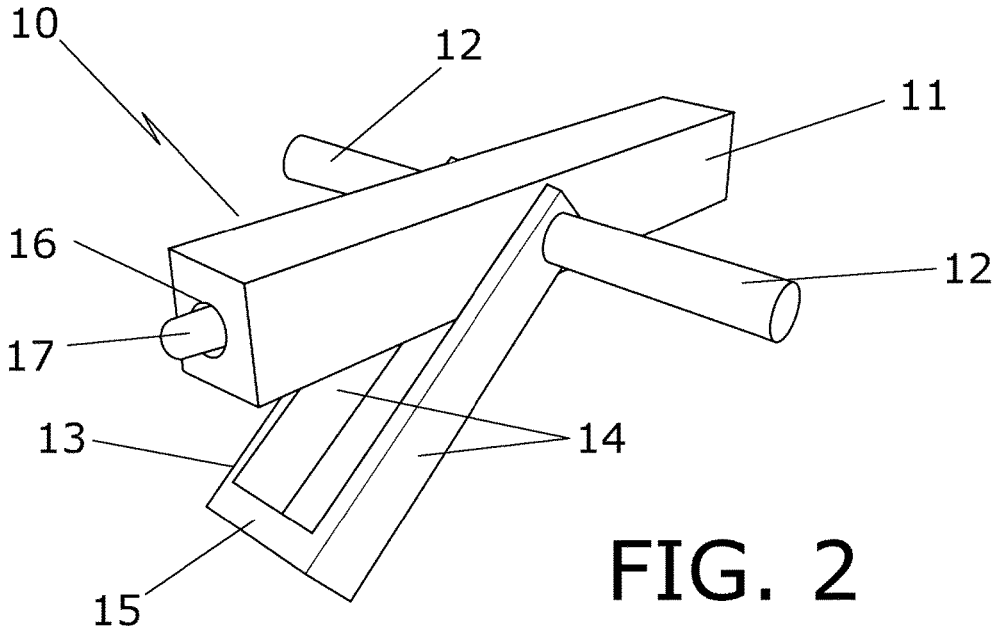
FIG. 2 is a front perspective view of the first exemplary embodiment with the stopper head extended, displaying the toy 10, the body 11, the handles 12, the swing 13, the arms 14, the plate 15, the aperture 16, and the stopper head 17.
Figure 3:
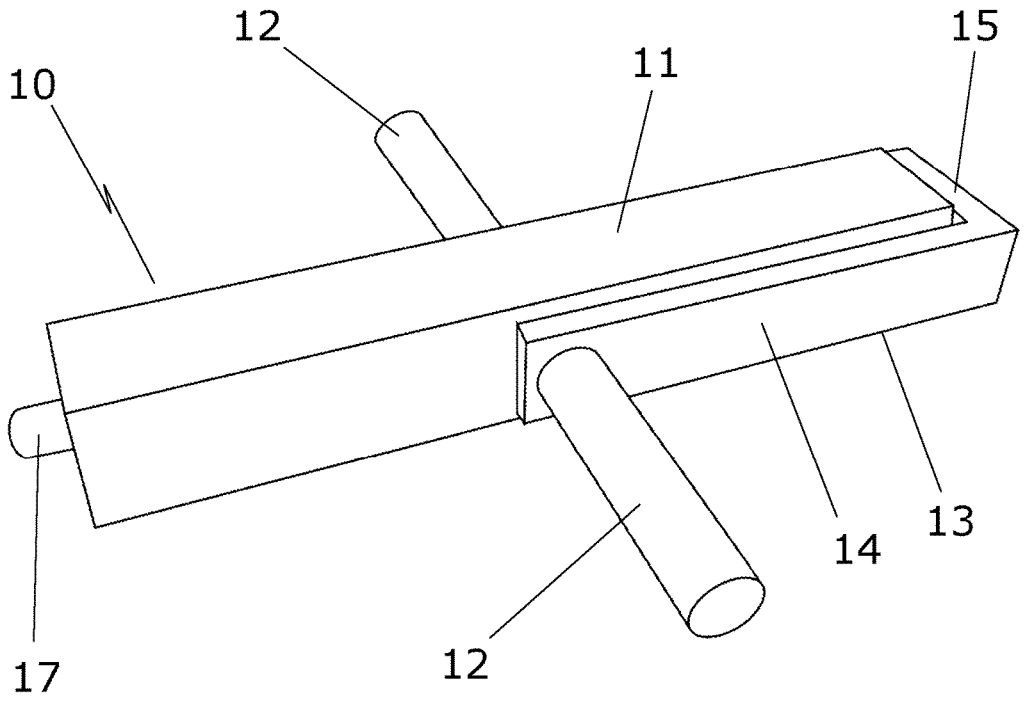
FIG. 3 is a top perspective view of the first exemplary embodiment with the stopper head extended, displaying the toy 10, the body 11, the handles 12, the swing 13, and the stopper head 17.

Referring now to the invention in more detail, the invention is directed to a mechanical spinning toy 10.

The first exemplary embodiment is comprised of a toy 10 which provides a rectangular body 11, with a cylindrical handle 12 protruding perpendicularly from the center of each long side. The handles 12 provide an axis of rotation for a swing 13, with two arms 14 extending down the long sides of the body 11, terminating in a plate 15 with a narrow clearance from the end of the body 11. The swing 13 rotates easily around the axis of the handles 12 in a 360° arc.

An aperture 16 extends longitudinally through the centerline of the body 11, containing a cylindrical stopperhead 17. A simple mechanism, well known to the art, causes the stopperhead 17 to protrude a short distance from one end of the body 11 or the other, and may be retracted with a quick twist of the user's wrists or a quick press of the user's thumb. This enables the swing 13 to continue rotating around the body 11.

To use the first exemplary embodiment, the user grasps the handles 12 and slowly spins the swing 13 around the body 11 of the toy 10, retracting the stopper head 17 as the swing 13 approaches it at each end of the body, by pressing the tip of the stopper head 17 with the thumb. The goal is to cause the swing 13 to spin as many times around the body 10 as possible without being stopped by the stopper head 17. The user must twist the body 11 of the toy at the same time the swing 13 is spinning to achieve this effect. This twisting enables the user to press the tips of the stopper head 17 in rapid succession with the thumbs. Alternately, the user may elect to twist the wrists to turn the body 11 of the toy 10. The toy 10 tests the user's reflexes and coordination, and may be useful in certain types of physical therapy.

The body 11, the handles 12, and the swing 13 are preferably manufactured from rigid, durable materials such as hardwood, fiberglass, and aluminum alloy. The stopper head 17 is preferably manufactured from a semi-rigid, durable material such as plastic.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A mechanical spinning toy, comprising:

a. a rectangular body with two long sides;

b. a cylindrical handle protruding perpendicularly from the center of each long side;

c. a swing, which employs the handles as an axis of rotation; and d. said swing having two arms extending down the long sides of the body, terminating in a plate with a narrow clearance from the end of the body;

e. wherein an aperture extends longitudinally through the centerline of the body, containing a retractable cylindrical stopperhead.

2. The mechanical spinning toy of claim 1, wherein the swing rotates easily around the axis of the handles in a 360° arc.

3. The mechanical spinning toy of claim 1, wherein the stopperhead protrudes a short distance from one end of the body, such that the swing is restricted from rotating when protruded and the swing freely rotates when the stopperhead is retracted.

4. The mechanical spinning toy of claim 3, wherein when the stopperhead is protruded from one end of the body, the stopperhead is retracted from the opposite end of the body.

5. The mechanical spinning toy of claim 4, wherein the user grasps the handles and slowly spins the swing around the body of the toy, retracting the stopperhead as the swing approaches it at each end of the body.

6. The mechanical spinning toy of claim 5, wherein the stopperhead is retracted by one of twisting or pressing on the stopperhead.

7. The mechanical spinning toy of claim 5, wherein the stopperhead is retracted from one end and projected from the opposite end by twisting the handles.

8. The mechanical spinning toy of claim 1, wherein the body, the handles, and the swing are constructed of a material taken from a group that includes hardwood, fiberglass, and aluminum alloy.

9. The mechanical spinning toy of claim 1, wherein the stopperhead is manufactured from a semi-rigid, durable material.

10. The mechanical spinning toy of claim 1, wherein when the stopperhead is protruded from one end of the body, the stopperhead is retracted from the opposite end of the body.

11. The mechanical spinning toy of claim 1, wherein the stopperhead is retracted by one of twisting or pressing on the stopperhead.

12. The mechanical spinning toy of claim 1, wherein the stopperhead is retracted from one end and projected from the opposite end by twisting the handles.

13. The mechanical spinning toy of claim 12, wherein the body, the handles, and the swing are constructed of one of hardwood, fiberglass, or aluminum alloy.

* * * * *